US012808104B2

(12) United States Patent
Suzuki et al.

(10) Patent No.: US 12,808,104 B2
(45) Date of Patent: Nov. 24, 2026

(54) SEWING MACHINE

(71) Applicant: BROTHER KOGYO KABUSHIKI KAISHA, Nagoya (JP)

(72) Inventors: Yasunori Suzuki, Nagoya (JP); Kentaro Torii, Nagoya (JP); Yoshihiro Minematsu, Nagoya (JP); Kazuki Kurokawa, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 19/230,339

(22) Filed: Jun. 6, 2025

(65) Prior Publication Data

US 2025/0389069 A1 Dec. 25, 2025

(30) Foreign Application Priority Data

Jun. 24, 2024 (JP) ..... 2024-101086

(51) Int. Cl.

| | |
|---|---|
| ***D05B 19/14*** | (2006.01) |
| ***D05B 29/00*** | (2006.01) |
| ***D05B 55/14*** | (2006.01) |
| ***D05B 69/26*** | (2006.01) |

(52) U.S. Cl.

CPC ..... *D05B 19/14* (2013.01); *D05B 29/00* (2013.01); *D05B 55/14* (2013.01); *D05B 69/26* (2013.01)

(58) Field of Classification Search

CPC ..... D05B 19/14; D05B 29/00; D05B 55/14
See application file for complete search history.

(56) References Cited

U.S. PATENT DOCUMENTS

| | | | | | |
|---|---|---|---|---|---|
| 4,393,794 | A * | 7/1983 | Eguchi | D05B 19/14 | 112/260 |
| 5,080,031 | A * | 1/1992 | Suzuki | D05B 65/06 | 112/300 |
| 5,086,719 | A * | 2/1992 | Ogawa | D05B 55/14 | 112/225 |
| 5,461,997 | A * | 10/1995 | Landen | D05B 29/02 | 112/237 |
| 5,551,361 | A * | 9/1996 | Clapp | D05B 29/02 | 112/475.01 |

(Continued)

FOREIGN PATENT DOCUMENTS

| | | |
|---|---|---|
| JP | 2009-291416 A | 12/2009 |
| JP | 2023-035293 A | 3/2023 |

(Continued)

*Primary Examiner* — Tajash D Patel
(74) *Attorney, Agent, or Firm* — Oliff PLC

(57) ABSTRACT

A sewing machine includes a needle bar, a needle plate formed with a needle hole, a presser bar, a sewing machine motor, a presser motor, and a controller. The controller is configured to perform a first-stitch operation of, at start or restart of sewing, driving the sewing machine motor to move the needle bar from a lower needle position to an upper needle position, and then driving the presser motor to move the presser bar from a lowered position to a normal position. The controller is configured to perform a second-stitch operation of, based on a detection result of movement of a sewing workpiece placed on the needle plate, driving the sewing machine motor to move the needle bar in the upper-lower direction in a state where the presser bar is located at the normal position.

11 Claims, 6 Drawing Sheets

(56) References Cited

U.S. PATENT DOCUMENTS

| | | | | |
|---|---|---|---|---|
| 2009/0101053 | A1* | 4/2009 | Nishimura | D05B 19/14<br>707/999.201 |
| 2009/0301369 | A1 | 12/2009 | Kawaguchi et al. | |
| 2023/0064230 | A1 | 3/2023 | Takei et al. | |

FOREIGN PATENT DOCUMENTS

| | | | | |
|---|---|---|---|---|
| WO | WO-2010058939 | A2 * | 5/2010 | D05B 65/06 |
| WO | WO-2022206002 | A1 * | 10/2022 | D05B 65/00 |

* cited by examiner

SEWING MACHINE

REFERENCE TO RELATED APPLICATIONS

This application claims priority from Japanese Patent Application No. 2024-101086 filed on Jun. 24, 2024. The entire content of the priority application is incorporated herein by reference.

BACKGROUND ART

A sewing machine including a movement detector for detecting movement of a sewing workpiece is known.

SUMMARY

A sewing machine adjusts stitch lengths based on a detection result of a movement detector that detects movement of a fabric. The movement detector includes a light receiving element for detecting light to detect the movement of the fabric, a main body having the light receiving element and attachable to and detachable from a presser bar of the sewing machine, and a presser support having a fabric presser that contacts the fabric and attachable to and detachable from the main body. The main body has a bottom surface having a window through which light passes. In a state where the presser support is attached to the main body, the fabric presser is located below the bottom surface of the main body. The movement detector outputs a detection result corresponding to the movement amount of the fabric to the sewing machine.

Another sewing machine is configured to, when a free motion mode is set, move a feed dog to a position where the feed dog does not protrude above a needle plate, and dispose a presser foot above a sewing workpiece by a particular distance to perform sewing. Specifically, the sewing machine switches the state of the feed dog to a non-operating position, then controls a presser foot lifting mechanism to lower the presser foot to a pressing position where the presser foot contacts the sewing workpiece, and detects the thickness of the sewing workpiece from a detection signal of a height position detector at the pressing position. Based on the detected thickness, in a state where the presser foot is stopped at a raised position raised by a particular distance from the upper surface of the sewing workpiece, the sewing machine controls a sewing machine motor and moves the needle bar to a set position immediately before the tip of the sewing needle pierces the sewing workpiece. The user performs sewing by manually moving the sewing workpiece in conjunction with driving of the needle bar.

In a case where sewing is performed in the free motion mode while driving the needle bar based on the detection result of the movement detector, when the needle bar rises at the start of sewing, the sewing needle may pull the sewing workpiece upward, and the sewing workpiece may lift from the needle plate. When the movement of the sewing workpiece at this time is detected by the movement detector, the sewing machine may perform a behavior that is not intended by the user, such as starting sewing based on the detection result of the movement detector.

In view of the foregoing, an example of an object of this disclosure is to provide a sewing machine that contributes to reducing the possibility of a behavior not intended by a user at the time of starting or restarting sewing in a case where sewing is performed using a movement detector.

According to one aspect, this specification discloses a sewing machine. The sewing machine includes a needle bar, a needle plate, a presser bar, a sewing machine motor, a presser motor, and a controller. The needle bar extends in an upper-lower direction. The needle plate is formed with a needle hole. The presser bar extends in the upper-lower direction. The sewing machine motor is configured to drive the needle bar to move in the upper-lower direction in a range including an upper needle position and a lower needle position. The upper needle position is a position where a lower end of a sewing needle attached to the needle bar is located above the needle plate. The lower needle position is a position where the lower end of the sewing needle attached to the needle bar is located below the needle plate. The presser motor is configured to drive the presser bar to move in the upper-lower direction in a range including a normal position and a lowered position. A lower end of the presser bar at the lowered position is located at a lower position than the lower end of the presser bar at the normal position. The controller is configured to perform a first-stitch operation of, at start or restart of sewing, driving the sewing machine motor to move the needle bar from the lower needle position to the upper needle position, and then driving the presser motor to move the presser bar from the lowered position to the normal position. The controller configured to perform a second-stitch operation of, based on a detection result of movement of a sewing workpiece placed on the needle plate, driving the sewing machine motor to move the needle bar in the upper-lower direction in a state where the presser bar is located at the normal position. The first-stitch operation performed by the controller of the sewing machine contributes to the movement detector or the presser foot attached to the presser bar at the lowered position restricting the upward movement of the sewing workpiece when the sewing needle pulls the sewing workpiece upward as the needle bar moves from the lower needle position to the upper needle position, compared with a case where the presser bar is located at the normal position during the sewing of the first stitch at the time of starting or restarting sewing. The first-stitch operation of the sewing machine contributes to preventing the sewing of the second stitch from being performed erroneously based on the detection result of the movement of the sewing workpiece in the first-stitch operation.

DESCRIPTION

Figure 1:
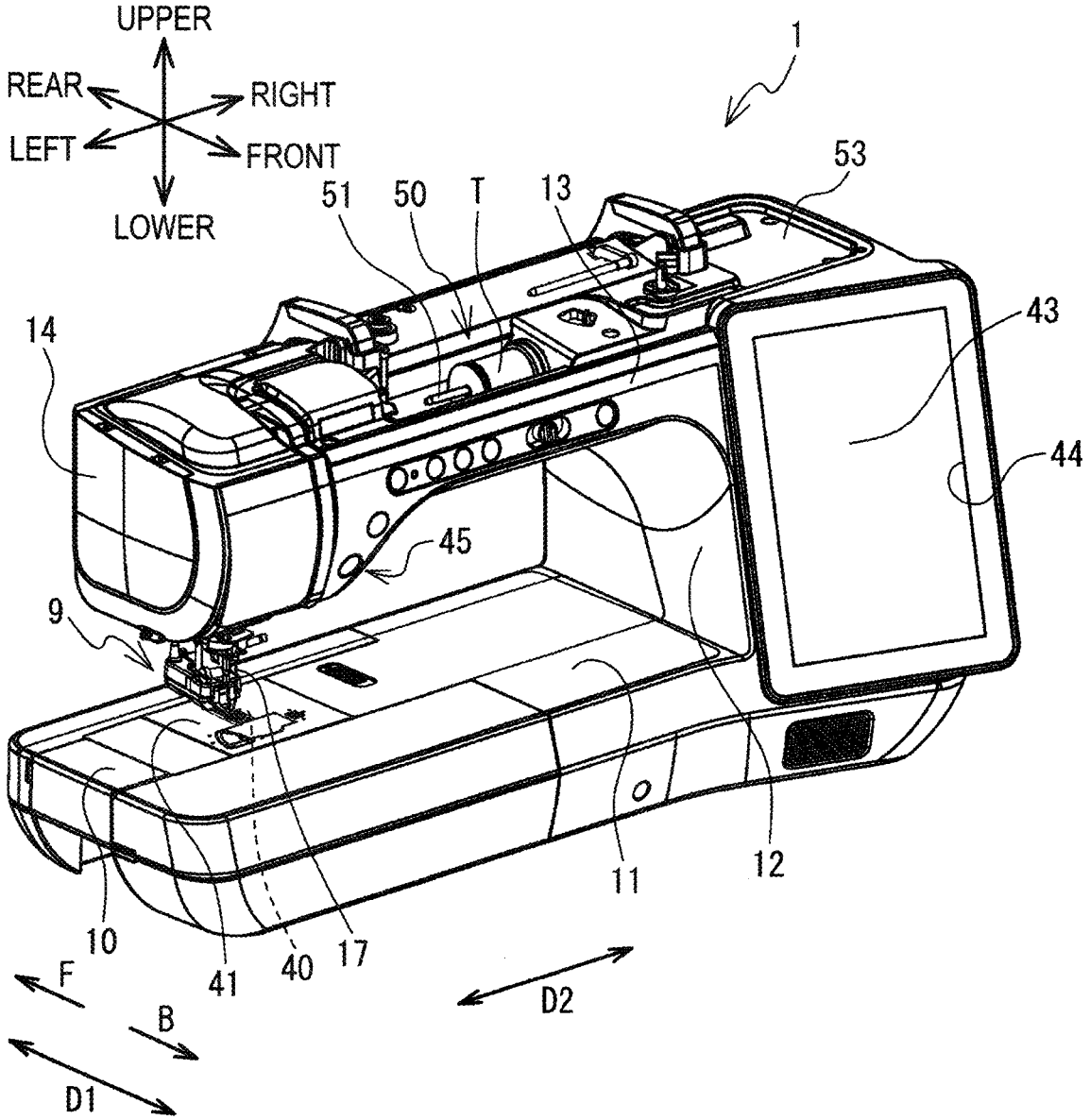
FIG. 1 is a perspective view of a sewing machine 1 to which a movement detector 9 is attached.

An embodiment of the present disclosure will be described with reference to the drawings. The upper-lower direction, the left-lower direction, the right-upper direction, the left-upper direction, and the right-lower direction in FIG. 1 are the upper-lower direction, the leftward direction, the rightward direction, the rearward direction, and the forward direction of a sewing machine 1, respectively. A longitudinal direction D2 of a bed 11 and an arm 13 is the left-right direction of the sewing machine 1. A short direction D1 of the bed 11 and the arm 13 in a horizontal plane is the front-rear direction of the sewing machine 1. In the sewing machine 1, the side on which a pillar 12 is disposed is the right side. The extending direction of the pillar 12 is the upper-lower direction of the sewing machine 1. A direction that is perpendicular to the upper-lower direction and that is from a needle bar 15 toward a presser bar 16 is a rearward direction, and is defined as a forward feed direction F. The direction opposite to the forward feed direction F is forward and is defined as a reverse feed direction B. The forward feed direction F and the reverse feed direction B are directions along the short direction D1.

As shown in FIG. 1, the sewing machine 1 includes the bed 11, the pillar 12, and the arm 13. The pillar 12 extends in the upper-lower direction. The bed 11 has a bed surface 10 and extends leftward from the lower end of the pillar 12. The arm 13 extends leftward from the upper end of the pillar 12 in parallel with the bed 11 above the bed 11. The arm 13 has a head 14 at the left end of the arm 13.

The bed surface 10 extends horizontally. The bed surface 10 includes a needle plate 41 extending horizontally. The needle plate 41 is formed with a needle hole 40 through which a sewing needle 17 attached to the needle bar 15 is inserted. The bed 11 includes a feed mechanism 31 shown in FIG. 4 and a hook mechanism (not shown), for example, below the needle plate 41. The feed mechanism 31 includes a feed dog 32. The feed mechanism 31 drives the feed dog 32 to move the sewing workpiece in the forward feed direction F or the reverse feed direction B by a particular movement amount. The forward feed direction F corresponds to the direction in which the sewing machine 1 is disposed with respect to the user. The hook mechanism includes a hook. The hook mechanism drives the hook to entangle an upper thread with a lower thread.

As shown in FIG. 1, a liquid crystal display (LCD) 43 and a touch screen 44 that are long in the upper-lower direction are disposed on the front side of the pillar 12. The LCD 43 displays messages for sewing work, for example. The touch screen 44 is disposed on the front surface of the LCD 43. When the user selects an item displayed on the LCD 43 with a pointing body such as a finger or a dedicated stylus pen described later, the touch screen 44 detects the selected position. The user inputs various instructions to the sewing machine 1 via the touch screen 44.

Figure 2A:
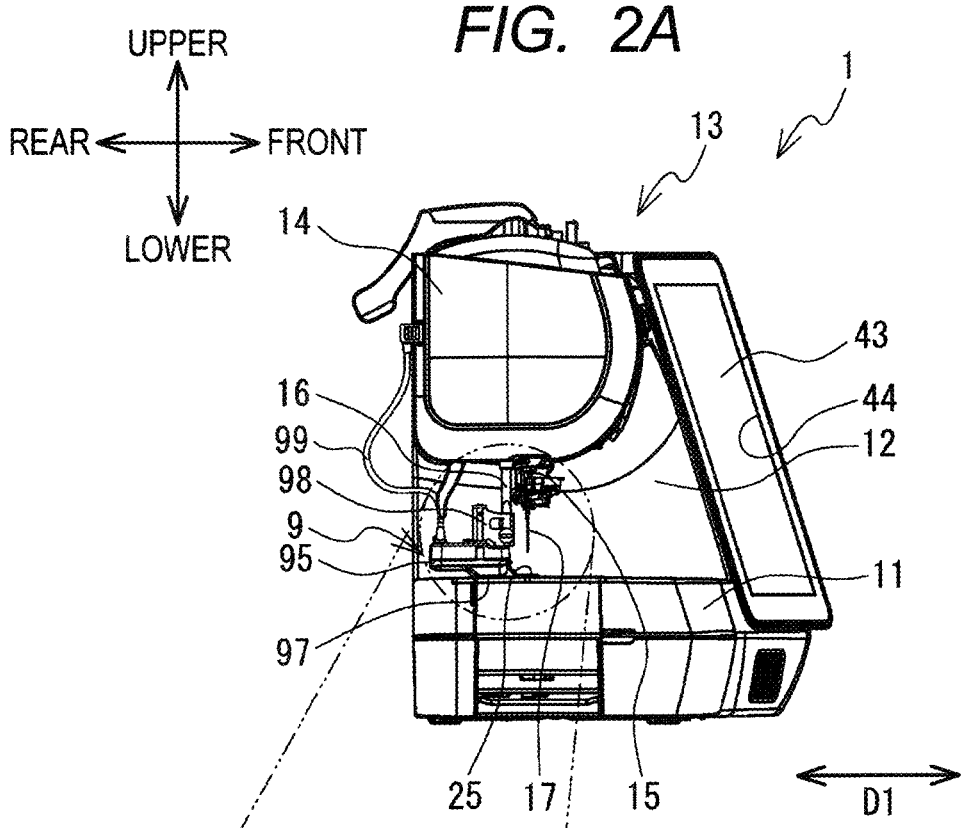
FIG. 2A is a left side view of the sewing machine 1 to which the movement detector 9 is attached.

A plurality of switches including a start-stop switch 45 are disposed on the front surface of the arm 13. The start-stop switch 45 is a switch for instructing the start and stop of a sewing operation. A sewing machine cover configured to open and close (not shown) is disposed on the upper portion of the arm 13. In FIGS. 1 and 2A, the sewing machine cover of the arm 13 is not shown. A thread storage portion 50 is disposed on an upper surface 53 of the arm 13 that is exposed in a state where the sewing machine cover is opened. The thread storage portion 50 is a recess that is recessed downward and stores a thread spool T around which an upper thread is wound. A thread spool pin 51 extends leftward from the right inner wall surface of the thread storage portion 50. The thread spool T is mounted on the sewing machine 1 by inserting the thread spool pin 51 into an insertion hole of the thread spool T.

Figure 2B:
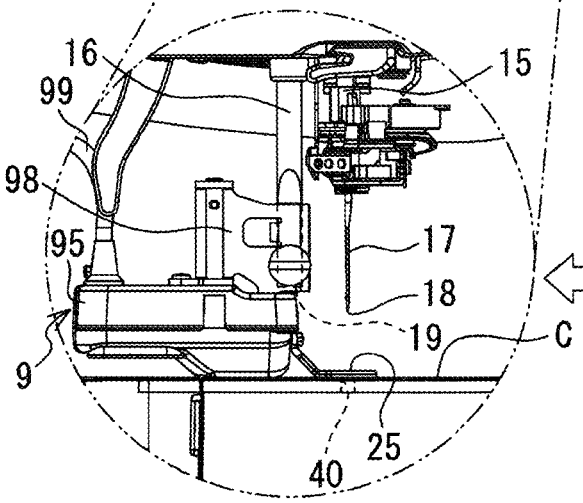
FIG. 2B is an enlarged view of the movement detector 9 in a state where a presser foot 25 contacts a sewing workpiece C.
Figure 2C:
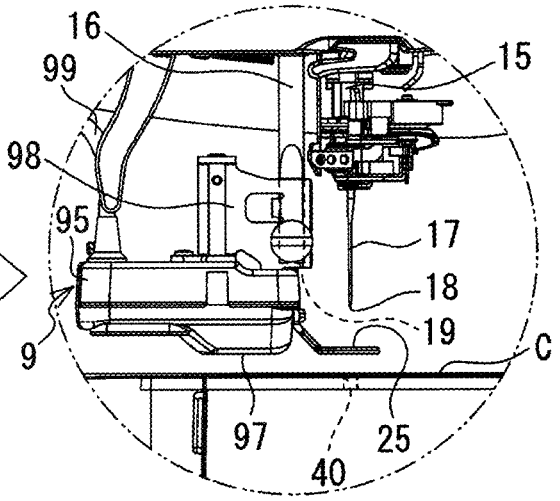
FIG. 2C is an enlarged view of the movement detector 9 in a state where the presser foot 25 is located a particular distance above the sewing workpiece C.

The head 14 includes a needle bar mechanism and a presser foot mechanism (not shown) inside the head 14. As shown in FIGS. 2A, 2B and 2C, the needle bar mechanism includes the needle bar 15 extending in the upper-lower direction, and reciprocates the needle bar 15 in the upper-lower direction. A lower end portion of the needle bar 15 protrudes downward from the lower end of the head 14. The sewing needle 17 is detachably attached to the lower end of the needle bar 15. The sewing needle 17 attached to the needle bar 15 reciprocates in the upper-lower direction. The upper thread inserted through the sewing needle 17 is entangled with the lower thread by the hook, and forms stitches on the sewing workpiece. The presser foot mechanism has the presser bar 16 extending in the upper-lower direction, and reciprocates the presser bar 16 in the upper-lower direction. A lower end portion of the presser bar 16 protrudes downward from the lower end of the head 14.

A movement detector (movement sensor) 9 is used when the user performs sewing while manually moving a sewing workpiece C placed on the bed surface 10 without using the feed dog 32. The movement detector 9 detects movement of the sewing workpiece C placed on the needle plate 41, and outputs a detection result corresponding to the amount of movement (movement amount) of the sewing workpiece C. The movement detector 9 detects the movement amount of the sewing workpiece C disposed on the bed 11 below the presser bar 16, and outputs the movement amount to the sewing machine 1. The sewing machine 1 controls the driving of a sewing machine motor 33 shown in FIG. 4 based on the movement amount per unit time of the sewing workpiece C, that is, movement speed, thereby adjusting (regulating) the length of the stitches formed on the sewing workpiece C. The presser foot 25 is attachable to and detachable from the movement detector 9. The presser foot 25 is disposed above the upper surface of the sewing workpiece C by a particular distance at a normal position described later, and restricts movement of the sewing workpiece C in the upper-lower direction within the particular distance, thereby preventing the sewing workpiece C placed on the bed surface 10 from lifting.

Figure 3:
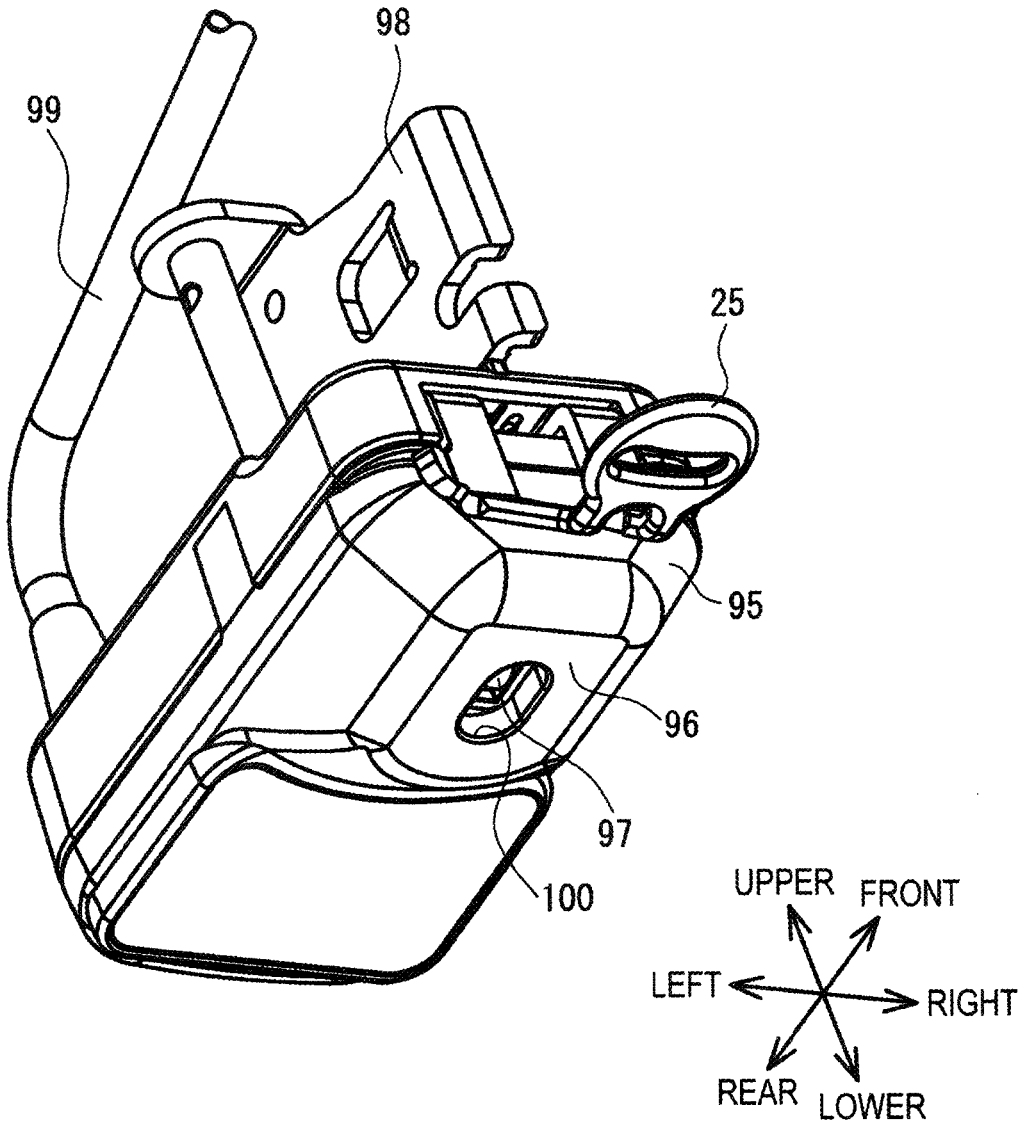
FIG. 3 is a perspective view of the movement detector 9.

As shown in FIG. 3, the movement detector 9 includes a housing 95, a sensor 97, a cable 99, and a mounting body (mounting bracket) 98. The housing 95 has a rectangular parallelepiped shape that is longer in the front-rear direction than in the left-right direction. The housing 95 is attachable to and detachable from the presser bar 16 of the sewing machine 1. The housing 95 accommodates the sensor 97.

Figure 4:
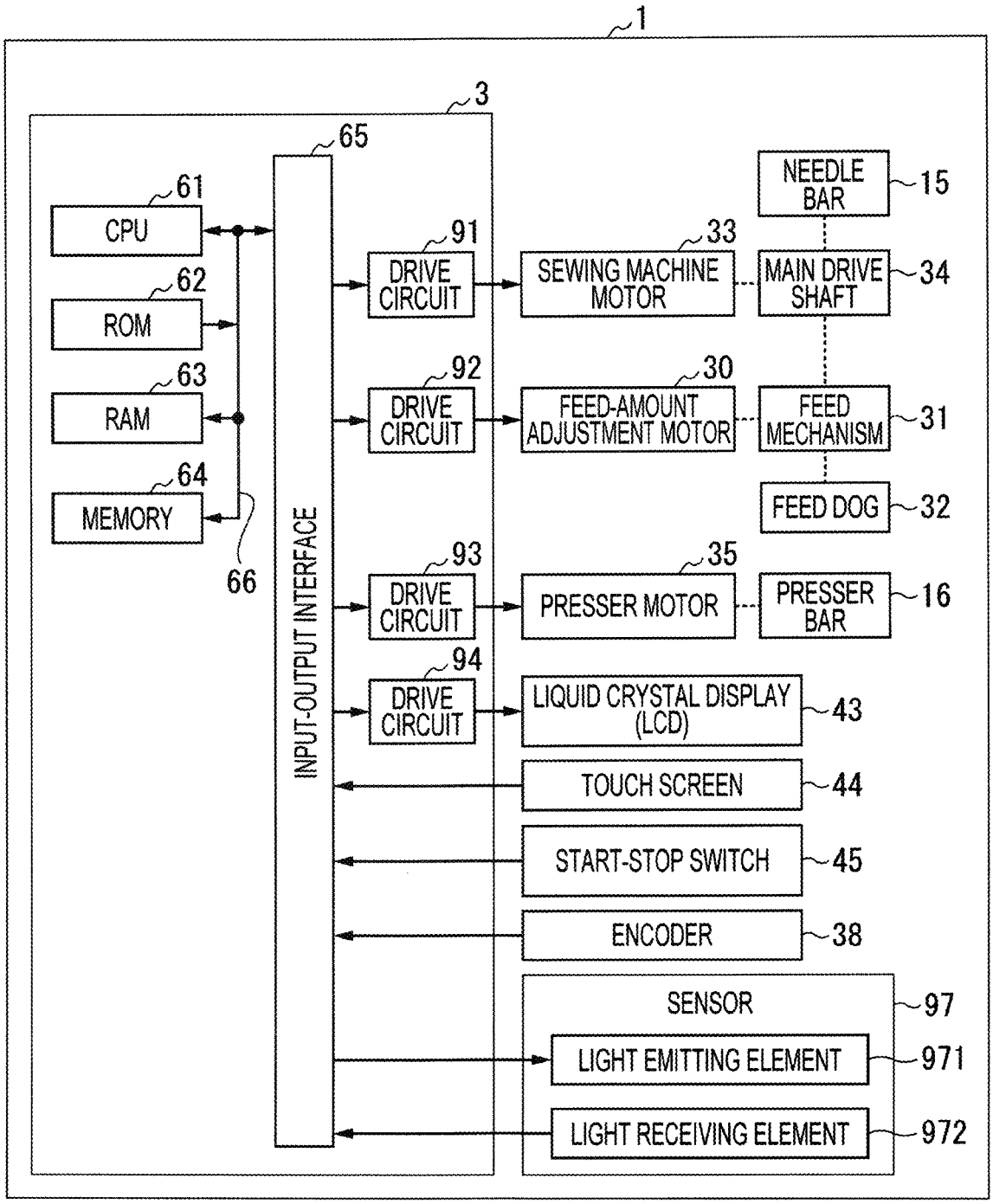
FIG. 4 is a block diagram showing an electrical configuration of the sewing machine 1.

The sensor 97 is located above an opening 100 formed in a lower surface 96 of the housing 95. As shown in FIG. 4, the sensor 97 includes a light emitting element 971 and a light receiving element 972. The light emitting element 971 and the light receiving element 972 are located above the opening 100. The light emitting element 971 emits light toward the sewing workpiece C to detect the movement amount of the sewing workpiece C. The light emitting element 971 is, for example, an infrared light emitting diode that emits infrared light. In a state where the movement detector 9 is attached to the presser bar 16 of the sewing machine 1, the light emitted by the light emitting element 971 is emitted downward. The emitted light passes through the opening 100 and reaches the sewing workpiece C, and is reflected. The light reflected by the sewing workpiece C passes through the opening 100. The light receiving element 972 is an element for detecting the light reflected by the sewing workpiece C located in a detection region, and detects the light reflected by the sewing workpiece C and converts the light into an electrical signal. The detection region is a circular region in a plan view and is located below the opening 100. The light receiving element 972 is, for example, an infrared imaging element that detects infrared light. The light emitting element 971 periodically emits light toward the sewing workpiece C, and the sensor 97 detects the movement amount of the sewing workpiece C per unit time. The movement detector 9 of the present embodiment detects each of a movement amount in the short direction D1 and a movement amount in the longitudinal direction D2. The movement detector 9 detects the movement amount in the short direction D1, where it is defined that a rearward movement amount is a positive (+) movement amount and a forward movement amount is a negative (−) movement amount. The movement detector 9 detects the movement amount in the longitudinal direction D2, where it is defined that a rightward movement amount is a positive (+) movement amount and a leftward movement amount is a negative (−) movement amount.

The cable 99 extends upward from rearward of the upper surface of the housing 95. The cable 99 is detachably connected to a connector (not shown) disposed at the back surface of the arm 13. The movement detector 9 outputs the movement amount of the sewing workpiece C per unit time to the sewing machine 1 via the cable 99. The mounting body 98 extends upward from the upper surface of the housing 95. The mounting body 98 is detachably attached to the presser bar 16. With this configuration, the movement detector 9 is detachably attached to the lower end of the presser bar 16.

In the sewing machine 1 having the above-described configuration, an operation when the sewing workpiece is conveyed by the feed dog 32 will be briefly described. When the sewing machine 1 detects that the start-stop switch 45 has been pressed, the hook mechanism, the feed mechanism 31, the needle bar mechanism, and the presser foot mechanism are driven synchronously. With this operation, the sewing needle 17 attached to the needle bar 15 forms stitches in the sewing workpiece C placed on the bed surface 10.

The electrical configuration of the sewing machine 1 will be described with reference to FIG. 4. A controller 3 of the sewing machine 1 includes a CPU 61, a ROM 62, a RAM 63, a memory 64, and an input-output interface 65. The CPU 61 is connected to the ROM 62, the RAM 63, the memory 64, and the input-output interface 65 via a bus 66.

The CPU 61 performs main control of the sewing machine 1 and performs various calculations and processing related to sewing in accordance with various programs stored in the ROM 62. The ROM 62 includes a plurality of storage areas including a program storage area (not shown). The program storage area stores various programs for operating the sewing machine 1, including a program for performing a main process described later. The RAM 63 includes a storage area for storing the operation result of a calculation process performed by the CPU 61. The memory 64 stores various parameters for the sewing machine 1 to perform various processes. The memory 64 stores a correspondence between a detection result of an encoder 38 described later and a vertical position of the needle bar 15, where it is defined that the angle of a main drive shaft 34 when the needle bar 15 is located at the top dead center is 0 degrees. The memory 64 stores a correspondence between the movement amount of the sewing workpiece C and the movement speed of the needle bar 15 in a sewing control operation described later.

Drive circuits 91, 92, 93 and 94 of the controller 3, the touch screen 44, the start-stop switch 45, and the encoder 38, and the light emitting element 971 and the light receiving element 972 of the sensor 97 of the movement detector 9 are connected to the input-output interface 65.

The sewing machine motor 33 is connected to the drive circuit 91. The drive circuit 91 drives the sewing machine motor 33 in accordance with a control signal from the CPU 61. When the sewing machine motor 33 is driven, the needle bar mechanism is driven via the main drive shaft 34 of the sewing machine 1, and the needle bar 15 reciprocates in the upper-lower direction. The sewing machine motor 33 moves the needle bar 15 in the upper-lower direction in a range including an upper needle position where a lower end 18 of the sewing needle 17 is above the needle plate 41 and a lower needle position where the lower end 18 of the sewing needle 17 is below the needle plate 41. The upper end of the movable range of the needle bar 15 is the top dead center, and the lower end is the bottom dead center. A feed-amount adjustment motor 30 is connected to the drive circuit 92. The feed-amount adjustment motor 30 adjusts the feed amount of the sewing workpiece C in the front-rear direction by the feed mechanism 31, by rotating an output shaft. The drive circuit 93 drives a presser motor 35 in accordance with a control signal from the CPU 61. Due to the driving of the presser motor 35, the presser bar 16 moves in the upper-lower direction independently of the driving of the main drive shaft 34 of the sewing machine 1. The presser motor 35 moves the presser bar 16 in the upper-lower direction in a range including a normal position and a lowered position where a lower end 19 of the presser bar 16 at the lowered position is located at a lower position than the lower end 19 of the presser bar 16 at the normal position. The upper end of the movable range of the presser bar 16 is a raised position above the normal position, and the lower end is a contact position where the presser foot 25 contacts the needle plate 41. The drive circuit 94 drives the LCD 43 in accordance with a control signal from the CPU 61, thereby displaying an image on the LCD 43. The encoder 38 outputs a detection result corresponding to the rotation angle of the sewing machine motor 33 to the input-output interface 65.

Figure 5:
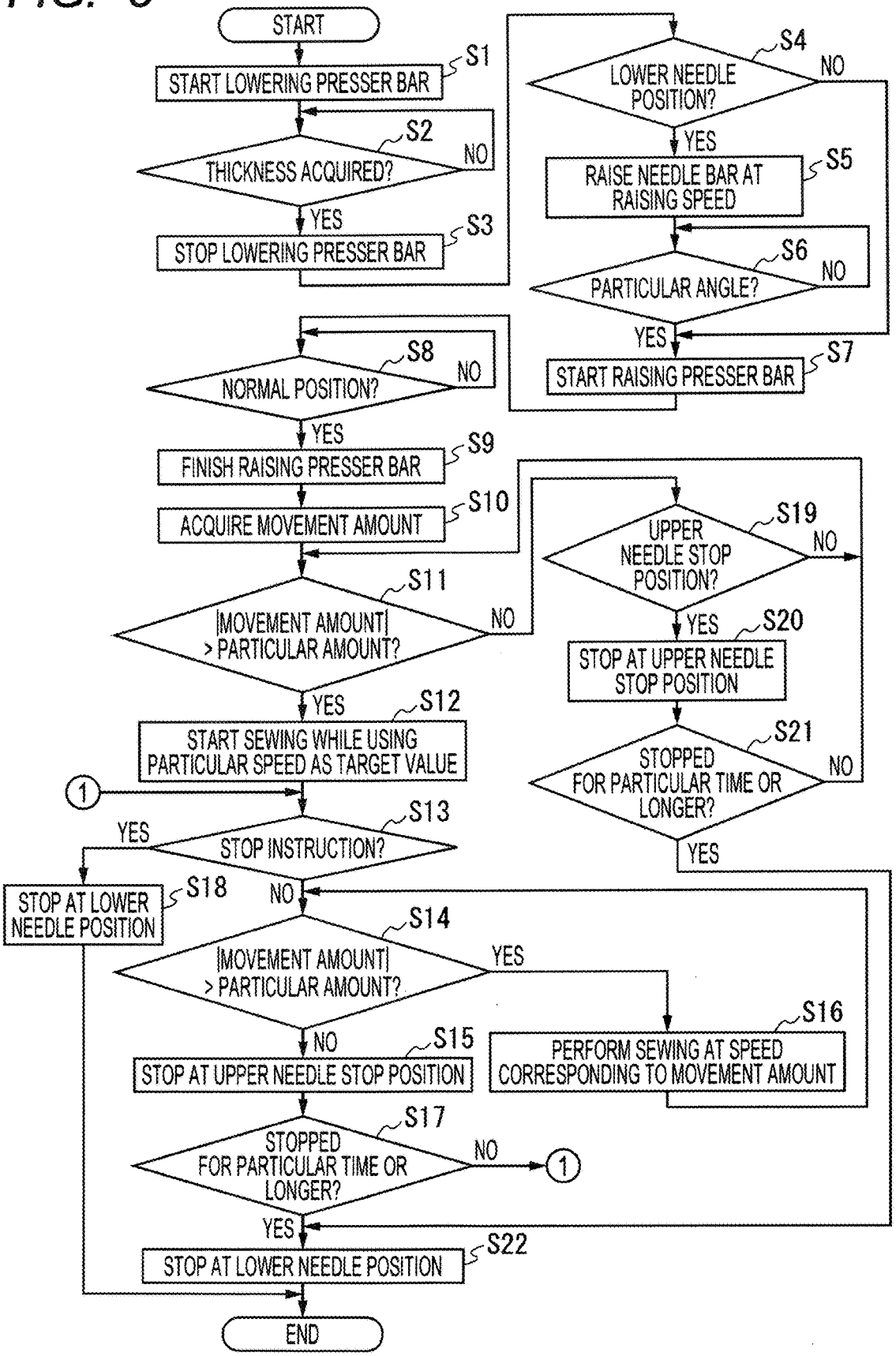
FIG. 5 is a flowchart of a main process performed in a case where the movement detector 9 is attached.

Referring to FIG. 5, the main process of the sewing machine 1 is described. In the main process, in a state where the movement detector 9 is attached to the presser bar 16, when the start-stop switch 45 is selected and a sewing instruction is detected at the start or restart of sewing, a sewing operation is performed on the sewing workpiece C. In the sewing operation, the needle bar 15 reciprocates in the upper-lower direction based on a detection result of the movement detector 9. When the controller 3 detects an instruction to perform the main process, the controller 3 reads a program for performing the main process stored in the program storage area of the ROM 62 to the RAM 63. The controller 3 then performs the following steps according to instructions included in the program read to the RAM 63. The program includes instructions for causing the controller 3 to perform the following processes. Various parameters for performing the main process are stored in the memory 64. Various types of data obtained during the main process are appropriately stored in the RAM 63. In the following description, step is abbreviated as S.

At the start of the main process, the presser bar 16 is located at the raised position, and the needle bar 15 is located at an upper needle stop position or a lower needle position. The upper needle stop position may be any position where the lower end 18 of the sewing needle 17 is above the needle plate 41. In the present embodiment, the upper needle stop position is a position where the angle of the main drive shaft 34 is 32 degrees and the needle bar 15 is slightly below the top dead center. The lower needle position is a position where the lower end 18 of the sewing needle 17 is below the needle plate 41. In the present embodiment, the lower needle position is a position on the way from the position where the lower end 18 of the sewing needle 17 is at the same height as the needle plate 41 toward the bottom dead center, with the angle of the main drive shaft 34 being 125 degrees. While performing the main process, the feed dog 32 is disposed at a position where the upper end of the feed dog 32 does not protrude above the needle plate 41. While performing the main process, unlike during sewing with the feed dog 32, the presser bar 16 does not move in the upper-lower direction in response to movement of the needle bar 15 in the upper-lower direction.

In response to detecting a sewing instruction via the start-stop switch 45, which is an input interface, the controller 3 starts the main process. In the main process, the controller 3 lowers the presser bar 16 to the lowered position, and performs a first-stitch operation of moving the needle bar 15 from the lower needle position to the upper needle position, and then moving the presser bar 16 from the lowered position to the normal position. In the present embodiment, the lowered position is a position where the movement detector 9 contacts the sewing workpiece C, and the normal position is a position above the lowered position by a particular distance. Specifically, as shown in FIG. 2B, the controller 3 drives the presser motor 35 to start lowering the presser bar 16 (S1), and determines whether the thickness of the sewing workpiece C has been acquired based on the position where the presser foot 25 contacts the sewing workpiece C (S2). In response to not acquiring the thickness (S2: NO), the controller 3 returns the processing to S2. In response to acquiring the thickness (S2: YES), the controller 3 stops lowering of the presser bar 16 at the position where the presser foot 25 of the movement detector 9 contacts the sewing workpiece C (S3).

The controller 3 determines whether the needle bar 15 is located at the lower needle position based on the detection result of the encoder 38 (S4). In response to determining that the needle bar 15 is located at the lower needle position (S4: YES), the controller 3 drives the sewing machine motor 33 to raise the needle bar 15 at a raising speed (S5). The raising speed may be a preset speed, for example, 70 rpm.

The controller 3 determines whether the rotation angle of the main drive shaft 34 has reached a particular angle based on the detection result of the encoder 38 (S6). The particular angle is an angle at which the needle bar 15 is located at the upper needle position, where the lower end 18 of the sewing needle 17 is above the needle plate 41. In the present embodiment, the upper needle position is a position where the lower end 18 of the sewing needle 17 is above the needle plate 41 and also above the upper surface of the sewing workpiece C. The upper needle position may be set based on the thickness of the sewing workpiece C acquired in S2, or based on the maximum thickness of sewing workpieces that are sewn normally.

In response to determining that the rotation angle of the main drive shaft 34 has not reached the particular angle (S6: NO), the controller 3 returns the processing to S6. In response to determining that the rotation angle of the main drive shaft 34 has reached the particular angle (S6: YES), the controller 3 starts raising the presser bar 16 (S7). Based on the drive amount of the presser motor 35 from the timing when S7 is performed, the controller 3 determines whether the presser bar 16 has reached the normal position (S8). As shown in FIG. 2C, after acquiring the thickness of the sewing workpiece C, the controller 3 drives the presser motor 35 to raise the presser bar 16 from the lowered position where the presser foot 25 contacts the sewing workpiece C, to the normal position. In the present embodiment, the normal position is a position above the lowered position by a particular distance. The particular distance may be set, for example, to a value from 1 mm to 4 mm.

In response to determining that the presser bar 16 has not reached the normal position (S8: NO), the controller 3 returns the processing to S8. In response to determining that the presser bar 16 has reached the normal position (S8: YES), the controller 3 ends raising of the presser bar 16. By the processing from S5 to S9, the controller 3 performs a first-stitch operation of driving the sewing machine motor 33 to move the needle bar 15 from the lower needle position to the upper needle position at the start or restart of sewing (S6: YES), and then driving the presser motor 35 to move the presser bar 16 from the lowered position to the normal position (S7). As a result of the first-stitch operation, the lower end 18 of the sewing needle 17 is located above the upper surface of the sewing workpiece C, and the presser foot 25 is located above the upper surface of the sewing workpiece C, allowing the user to move the sewing workpiece C smoothly in a horizontal direction.

The controller 3 acquires the movement amount of the sewing workpiece C based on the detection result of the movement detector 9 that is acquired after the presser bar 16 has moved to the normal position or after the needle bar 15 has moved to a particular position where the lower end 18 of the sewing needle 17 is above the needle plate 41 (S10). The particular position may be any position where the lower end 18 of the sewing needle 17 is above the needle plate 41. For example, the particular position is at the same position as or a higher position than the upper needle position in the upper-lower direction. In the present embodiment, the particular position is at the same position as the upper needle position in the upper-lower direction.

The controller 3 determines whether the absolute value of the movement amount acquired in S10 is greater than a particular amount (S11). The particular amount may be set appropriately to a value greater than or equal to zero in consideration of the detection accuracy of the movement detector 9, for example. The movement detector 9 in the present embodiment detects both the movement amount in the short direction D1 and the movement amount in the longitudinal direction D2. Thus, the controller 3 may determine whether the absolute value of at least one of these movement amounts is greater than the particular amount, for example. Alternatively, the controller 3 may calculate the vector length based on both the movement amount in the short direction D1 and the movement amount in the longitudinal direction D2 as the movement amount to determine whether the calculated movement amount is greater than the particular amount. In response to determining that the absolute value of the movement amount is not greater than the particular amount (S11: NO), the controller 3 determines whether the needle bar 15 is located at the upper needle stop position based on the detection result of the encoder 38 (S19).

In response to determining that the needle bar 15 is not located at the upper needle stop position (S19: NO), the controller 3 returns the processing to S11. In response to determining that the needle bar 15 is located at the upper needle stop position (S19: YES), the controller 3 stops driving of the sewing machine motor 33 to stop the needle bar 15 at the upper needle stop position (S20). The controller 3 then determines whether the needle bar 15 has remained stopped for a particular time or longer (S21). In response to determining that the needle bar 15 has not remained stopped for the particular time or longer (S21: NO), the controller 3 returns the processing to S11. In response to determining that the needle bar 15 has remained stopped for the particular time or longer (S21: YES), the controller 3 moves the needle bar 15 to the lower needle position (S22). Then, the controller 3 ends the main process.

In response to determining that the movement amount is greater than the particular amount (S11: YES), the controller 3 performs a second-stitch operation of driving the sewing machine motor 33 based on the detection result of the movement detector 9 and moving the needle bar 15 in the upper-lower direction in a state where the presser bar 16 is located at the normal position (S12). In other words, in the second-stitch operation, in response to determining that the sewing workpiece C has moved more than the particular amount (S11: YES) based on the detection result of the movement detector 9 that is acquired after the presser bar 16 has moved to the normal position in the first-stitch operation, the controller 3 starts moving the needle bar 15 in the upper-lower direction at a particular speed in a state where the presser bar 16 is located at the normal position (S12). The particular speed may be the same as or different from the raising speed in S5. For example, the particular speed is 400 rpm. The controller 3 determines whether a stop instruction has been detected (S13). When the user finishes or interrupts the sewing, the user presses the start-stop switch 45 to input a stop instruction. In response to detecting the stop instruction (S13: YES), the controller 3 controls the sewing machine motor 33 based on the detection result of the encoder 38 to stop the needle bar 15 at the lower needle position (S18). In response to not detecting the stop instruction (S13: NO), the controller 3 determines whether the movement amount is greater than the particular amount (S14). The particular amount in S14 may be the same as or different from the particular amount in S11.

In response to determining that the movement amount is greater than the particular amount (S14: YES), the controller 3 performs a sewing control operation after the second-stitch operation in S12. The sewing control operation is an operation of driving the sewing machine motor 33 based on the detection result of the movement detector 9 to move the needle bar 15 in the upper-lower direction at a speed corresponding to the movement amount of the sewing workpiece C, based on a correspondence between the movement amount of the sewing workpiece C and the movement speed of the needle bar 15 (S16). The correspondence is stored in the memory 64.

During the sewing control operation, in response to determining that the movement amount of the sewing workpiece C is smaller than or equal to the particular amount based on the detection result of the movement detector 9 (S14: NO), the controller 3 stops the needle bar 15 at the upper needle stop position (S15). The upper needle stop position in S15 may be the same as or different from that in S20. The controller 3 determines whether the needle bar 15 has remained stopped at the upper needle stop position for a particular time or longer (S17). The particular time in S17 may be the same as or different from that in S21. In response to determining that the needle bar 15 has not remained stopped for the particular time or longer (S17: NO), the controller 3 returns the processing to S13. In response to determining that the needle bar 15 has remained stopped for the particular time or longer (S17: YES), the controller 3 controls the sewing machine motor 33 based on the detection result of the encoder 38 to move the needle bar 15 to the lower needle position (S22). Then, the controller 3 ends the main process.

Figure 6:
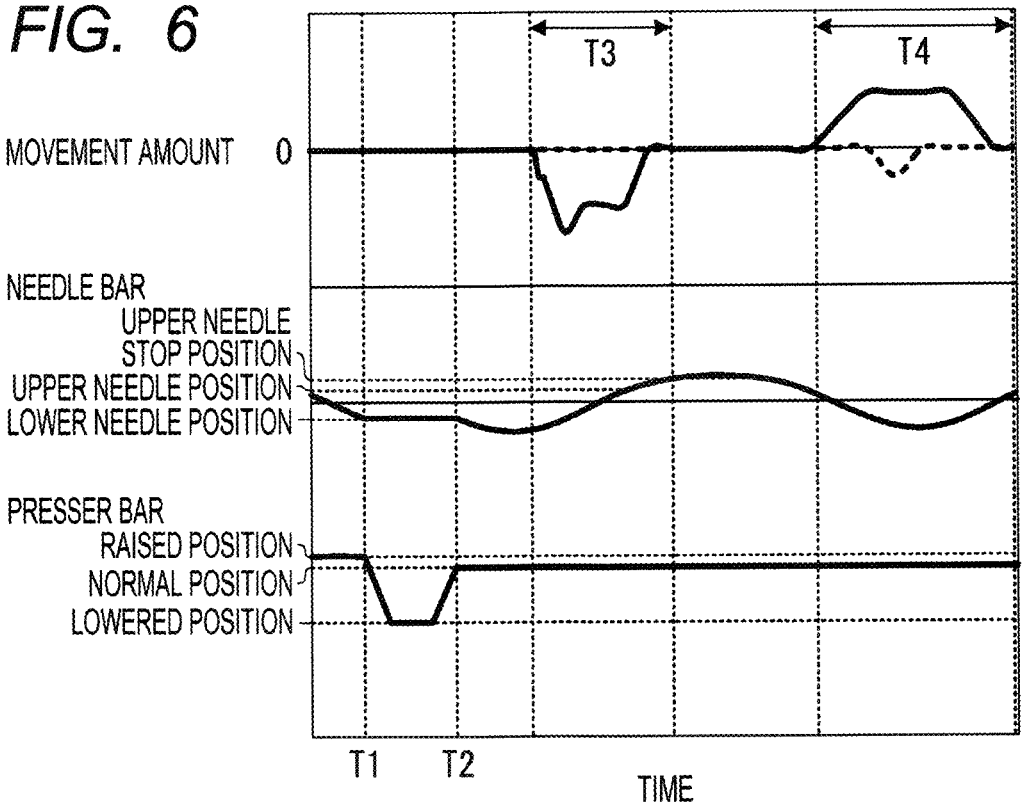
FIG. 6 is a graph showing results of an evaluation test.
Figure 7:
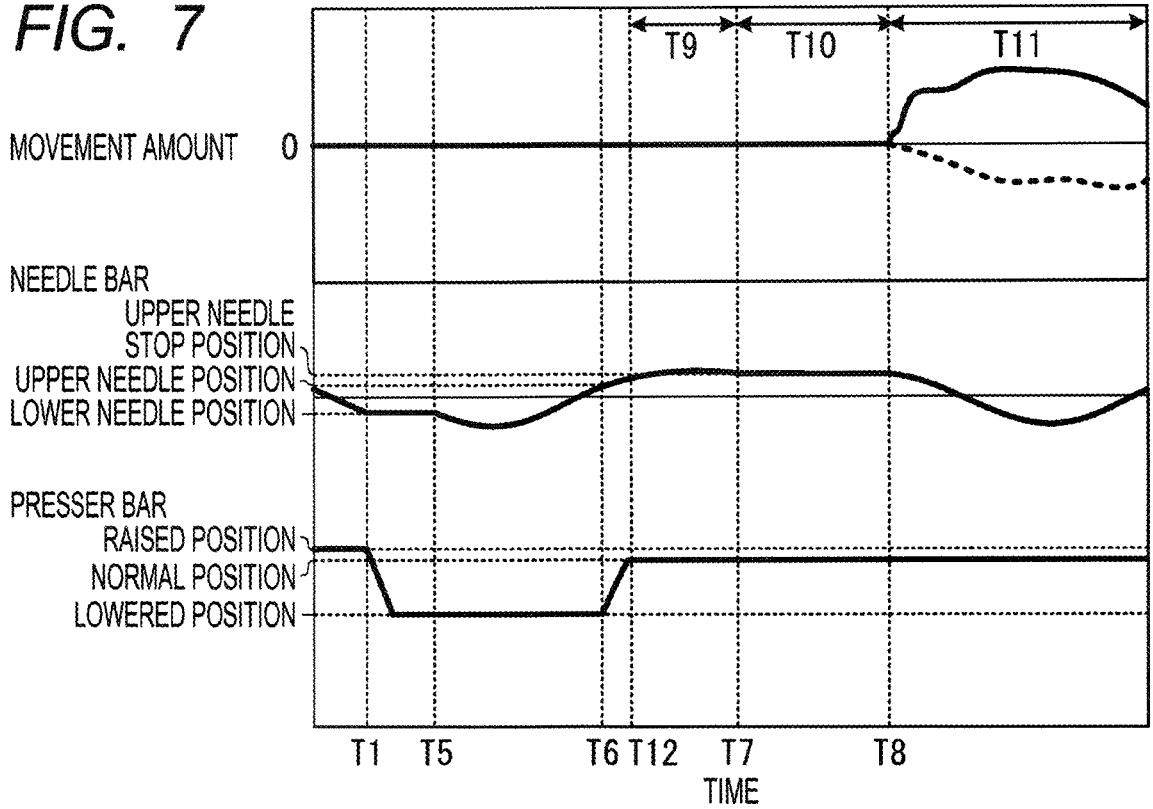
FIG. 7 is a graph showing results of an evaluation test.

Referring to FIGS. 5 to 7, evaluation tests will be described for a comparative example and the embodiment. The evaluation test according to the comparative example is a case where the sewing machine 1 performs a known sewing operation based on the detection result of the movement detector 9. The evaluation test according to the embodiment is a case where the sewing machine 1 performs the above-described main process. FIGS. 6 and 7 show the temporal changes of the movement amount per unit time of the sewing workpiece C based on the detection result of the movement detector 9 at the start or restart of sewing, the position of the needle bar 15 in the upper-lower direction, and the position of the presser bar 16 in the upper-lower direction. In FIGS. 6 and 7, the movement amount per unit time in the short direction D1 detected by the movement detector 9 is indicated by a solid line, and the movement amount in the longitudinal direction D2 is indicated by a dashed line. The evaluation test is started in a state where the presser bar 16 is located at the raised position and the needle bar 15 is located at the lower needle position. More specifically, before time T1 in FIGS. 6 and 7, the needle bar 15 is stopped at the upper needle position. The evaluator of the evaluation test first lowers the needle bar 15 to the lower needle position to pierce the sewing workpiece C with the sewing needle 17 at a position where sewing is to be started. Then, at time T1, the evaluator inputs a sewing instruction to the sewing machine 1 to start the evaluation test.

As shown in FIG. 6, in a case where the sewing operation of the comparative example is performed, in response to detecting a sewing instruction at timing T1, the sewing machine 1 drives the presser motor 35 to start lowering the presser bar 16. After acquiring the thickness of the sewing workpiece C based on the position where the presser foot 25 contacts the sewing workpiece C, the sewing machine 1 stops the lowering of the presser bar 16. Thereafter, in order to allow manual movement of the sewing workpiece C in a horizontal direction, the sewing machine 1 raises the presser bar 16 to the normal position. By raising the presser bar 16, a vertical gap of several millimeters is formed between the sewing workpiece C and the presser foot 25 (the movement detector 9). At timing T2, in a state where the presser bar 16 is located at the normal position, the sewing machine 1 raises the needle bar 15 toward the upper needle stop position. During the process of raising the needle bar 15, when the tip (lower end) of the sewing needle 17 is withdrawn from the sewing workpiece C, the portion of the sewing workpiece C that was pierced by the sewing needle 17 rises (lifts) together with the sewing needle 17 and moves in the upper-lower direction between the needle plate 41 and the presser foot 25 (the movement detector 9). During periods T3 and T4, the movement detector 9 detects this movement of the sewing workpiece C. Thus, based on the detection result of the movement detector 9, the sewing machine 1 does not stop the needle bar 15 at the upper needle stop position but continues to drive the sewing machine motor 33 to perform a second stitch.

As shown in FIGS. 5 and 7, in a case where the main process of the embodiment is performed, in response to detecting a sewing instruction at timing T1, the sewing machine 1 drives the presser motor 35 to start lowering the presser bar 16 (S1), and acquires the thickness of the sewing workpiece C based on the position where the presser foot 25 contacts the sewing workpiece C (S2: YES), and thereafter stops the lowering of the presser bar 16 (S3). Before raising the presser bar 16 to the normal position, the sewing machine 1 drives the sewing machine motor 33 at timing T5 (S4: YES, S5) to raise the needle bar 15. During the process of raising the needle bar 15, even when the tip of the sewing needle 17 is withdrawn from the sewing workpiece C, the presser foot 25 and the housing 95 of the movement detector 9 are pressing the sewing workpiece C from above, preventing the portion of the sewing workpiece C that was pierced by the sewing needle 17 from rising (lifting) together with the sewing needle 17. Thus, the movement detector 9 does not detect the movement of the sewing workpiece C when the tip of the sewing needle 17 is withdrawn from the sewing workpiece C. The sewing machine 1 starts raising the presser bar 16 at timing T6, when the needle bar 15 reaches the upper needle position (S7). Based on the detection result of the movement detector 9 acquired after the presser bar 16 has moved to the normal position at timing T12, or the detection result of the movement detector 9 acquired after the needle bar 15 has moved to a particular position where the lower end 18 of the sewing needle 17 is above the needle plate 41 at timing T6, the movement detector 9 does not detect movement of the sewing workpiece C during period T9 (S11: NO). The sewing machine 1 controls the sewing machine motor 33 based on the detection result of the encoder 38 to stop the needle bar 15 at the upper needle stop position at timing T7 (S20). After maintaining the stop at the upper needle stop position based on the detection result of the movement detector 9 during period T10 (S11: NO), the sewing machine 1 starts movement of the needle bar 15 in the upper-lower direction at timing T8 based on the detection result of the movement detector 9 during period T11 (S11: YES) (S12).

From the results of the above-described evaluation tests, it has been confirmed that, when the sewing machine 1 starts or restarts sewing based on the detection result of the movement detector 9 from the state where the needle bar 15 is located at the lower needle position, the main process performed by the sewing machine 1 contributes to restricting the lifting of the sewing workpiece C and reducing the possibility of behavior that is unintended by the user.

In the above-described embodiment, the sewing machine 1 is an example of a sewing machine of the present disclosure. The controller 3 is an example of a controller (processor) of the present disclosure. The movement detector 9 is an example of a movement detector of the present disclosure. The needle bar 15 is an example of a needle bar of the present disclosure. The presser bar 16 is an example of a presser bar of the present disclosure. The sewing needle 17 is an example of a sewing needle of the present disclosure. The sewing machine motor 33 is an example of a sewing machine motor of the present disclosure. The presser motor 35 is an example of a presser motor of the present disclosure. The needle plate 41 is an example of a needle plate of the present disclosure. The needle hole 40 is an example of a needle hole of the present disclosure. The sewing workpiece C is an example of a sewing workpiece of the present disclosure. The start-stop switch 45 is an example of an input interface of the present disclosure. The processing of S15 is an example of a stop operation of the present disclosure. The processing from S5 to S9 is an example of a first-stitch operation of the present disclosure. The processing of the S12 is an example of a second-stitch operation of the present disclosure. The processing of S16 is an example of a sewing control operation of the present disclosure.

The sewing machine 1 of the above-described embodiment includes the needle bar 15, the needle plate 41, the presser bar 16, the sewing machine motor 33, the presser motor 35, and the controller 3. The needle bar 15 extends in the upper-lower direction. The needle plate 41 is formed with the needle hole 40 through which the sewing needle 17 attached to the needle bar 15 is inserted. The presser bar 16 extends in the upper-lower direction and is configured that the movement detector 9 is attached for detecting movement of the sewing workpiece C placed on the needle plate 41. The sewing machine motor 33 moves the needle bar 15 in the upper-lower direction in a range including the upper needle position where the lower end 18 of the sewing needle 17 is above the needle plate 41 and the lower needle position where the lower end 18 of the sewing needle 17 is below the needle plate 41. The presser motor 35 moves the presser bar 16 in the upper-lower direction in a range including the normal position and the lowered position where the lower end 19 of the presser bar 16 at the lowered position is located at a lower position than the lower end 19 of the presser bar 16 at the normal position. The controller 3 performs the first-stitch operation in at least the start or restart of sewing, by driving the sewing machine motor 33 to move the needle bar 15 from the lower needle position to the upper needle position, and then driving the presser motor 35 to move the presser bar 16 from the lowered position to the normal position (S5 to S9). The controller 3 performs the second-stitch operation by moving the needle bar 15 in the upper-lower direction in a state where the presser bar 16 is located at the normal position based on the detection result of the movement detector 9 (S12). The first-stitch operation performed by the controller 3 of the sewing machine 1 contributes to restricting upward movement of the sewing workpiece C by the movement detector 9 when the sewing needle 17 pulls the sewing workpiece C upward as the needle bar 15 moves from the lower needle position to the upper needle position, compared with a case where the presser bar 16 is located at the normal position at the first stitch at the start or restart of sewing. The first-stitch operation of the sewing machine 1 contributes to preventing the second-stitch sewing from being performed erroneously based on the detection result of the movement detector 9 during the first-stitch operation.

The upper needle position is a position where the lower end 18 of the sewing needle 17 is located above the needle plate 41 and above the upper surface of the sewing workpiece C. The first-stitch operation performed by the controller 3 of the sewing machine 1 contributes to restricting the upward movement of the sewing workpiece C by the movement detector 9 when the sewing needle 17 pulls the sewing workpiece C upward as the needle bar 15 moves from the lower needle position to the upper needle position, compared with a case where the presser bar 16 is moved from the lowered position to the normal position before the needle bar 15 moves to a position where the lower end 18 of the sewing needle 17 is located above the upper surface of the sewing workpiece C.

In the second-stitch operation, the controller 3 moves the needle bar 15 in the upper-lower direction at a particular speed in a state where the presser bar 16 is located at the normal position in a case where the sewing workpiece C has moved more than a particular amount (S11: YES) based on the detection result of the movement detector 9 acquired after the presser bar 16 has moved to the normal position in the first-stitch operation (S12). The second-stitch operation performed by the controller 3 of the sewing machine 1 contributes to preventing the second-stitch sewing from being performed erroneously based on the detection result of the movement detector 9 during the first-stitch operation, compared with a case where the second-stitch sewing is performed based on the detection result of the movement detector 9 acquired before the presser bar 16 is moved to the normal position.

In the second-stitch operation, the controller 3 moves the needle bar 15 in the upper-lower direction at a particular speed in a state where the presser bar 16 is located at the normal position (S12) based on the detection result of the movement detector 9 acquired after the needle bar 15 has moved to the particular position where the lower end 18 of the sewing needle 17 is above the needle plate 41 in the first-stitch operation, in a case where the sewing workpiece C has moved more than a particular amount (S11: YES). The second-stitch operation performed by the controller 3 of the sewing machine 1 contributes to preventing the second-stitch sewing from being performed erroneously based on the detection result of the movement detector 9 in the first-stitch operation, compared with the case where the second-stitch sewing is performed based on the detection result of the movement detector 9 acquired before the needle bar 15 moves to the particular position.

After the second-stitch operation, the controller 3 performs the sewing control operation of driving the sewing machine motor 33 to move the needle bar 15 in the upper-lower direction at a speed corresponding to the movement amount of the sewing workpiece C, based on the detection result of the movement detector 9 (S16). During the sewing control operation, the controller 3 performs a stop operation of stopping driving of the sewing machine motor 33 to stop the needle bar 15 at the upper needle stop position where the lower end 18 of the sewing needle 17 is above the needle plate 41 (S15) in a case where the movement amount of the sewing workpiece C is smaller than or equal to a particular amount based on the detection result of the movement detector 9. The stop operation performed by the controller 3 of the sewing machine 1 contributes to smoothly resuming the sewing from an interrupted state by stopping the needle bar 15 at the upper needle stop position.

In the first-stitch operation, the controller 3 lowers the presser bar 16 to the lowered position where the lowered position is the position where the movement detector 9 contacts the sewing workpiece C and the normal position is the position a particular distance above the lowered position, and moves the needle bar 15 from the lower needle position to the upper needle position (S6: YES), and thereafter moves the presser bar 16 from the lowered position to the normal position (S7 to S9). The first-stitch operation performed by the controller 3 of the sewing machine 1 contributes to restricting the upward movement of the sewing workpiece C by the movement detector 9 when the sewing needle 17 pulls the sewing workpiece C upward as the needle bar 15 moves from the lower needle position to the upper needle position, compared with a case where the movement detector 9 does not contact the sewing workpiece C at the lowered position.

The sewing machine 1 includes the start-stop switch 45 as an input interface. The controller 3 performs the first-stitch operation in response to detecting a sewing instruction via the input interface. The first-stitch operation of the sewing machine 1 contributes to preventing the first-stitch operation from being performed at a timing unintended by the user.

While the disclosure has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the disclosure, and not limiting the disclosure. Various changes may be made without departing from the spirit and scope of the disclosure. Thus, the disclosure is intended to embrace all known or later developed alternatives, modifications, variations, improvements, and/or substantial equivalents. Some specific examples of potential alternatives, modifications, or variations in the described disclosure are provided below.

For example, the sewing machine 1 may be a sewing machine dedicated to sewing using the movement detector 9, and in this case, the feed-amount adjustment motor 30, the feed mechanism 31, and the feed dog 32 may be omitted. The sewing machine 1 may include the movement detector 9, or the movement detector 9 may be omitted. The movement detector 9 detects the movement of the sewing workpiece C placed on the needle plate 41, and the configuration and shape of the movement detector 9 may be changed as appropriate, for example. The movement detector 9 may be built into the sewing machine 1. In this case, for example, a configuration corresponding to the movement detector 9 may be built in the bed 11 or the head 14. In this case, a presser foot attached to the presser bar 16 may contact and press the sewing workpiece C. The movement detector 9 may detect the movement of the sewing workpiece C (that is, whether the sewing workpiece C has moved), but the movement detector 9 may not detect the movement amount of the sewing workpiece C. The movement detector 9 may detect either one of the movement amount of the sewing workpiece C in the short direction D1 and the movement amount in the longitudinal direction D2. The movement detector 9 may detect the movement amount in any horizontal direction. The detection result of the movement detector 9 may indicate the movement amount of the sewing workpiece C and may not indicate the movement direction.

The input interface may be any device and method that allows information to be input to the controller 3, such as a keyboard, pointing devices such as a mouse, trackball, touchpad, and graphics tablet, a scanner, a touchscreen incorporated into the display, audio input devices such as voice recognition systems, and other types of input devices such as microphones.

The program including the instructions for performing the main process of FIG. 5 may be stored in a memory of each apparatus by the time the controller 3 executes the program. Thus, the method of acquiring the program, the acquisition path, and the device that stores the program may be changed as appropriate. The program executed by the controller 3 may be received from another apparatus via a cable or wireless communication and stored in the memory. The other apparatuses include, for example, a PC and a server connected via a network.

The steps of the main process are not limited to the example of being performed by the controller 3, and some or all of the steps may be performed by another electronic device (for example, an ASIC). The steps of the main process may be processed in a distributed manner by a plurality of electronic devices (for example, a plurality of CPUs). The order of the steps of the main process may be changed, and steps may be omitted or added as appropriate. The following changes may be made to the main process as appropriate.

The method of acquiring the thickness of the sewing workpiece C may be changed as appropriate, and the controller 3 may dispose the presser bar 16 at the lowered position without acquiring the thickness of the sewing workpiece C. The lowered position and the normal position may be changed as appropriate. The lowered position may be a position where the presser foot 25 contacts the sewing workpiece C, or may be a position several millimeters above the position where the presser foot 25 contacts the sewing workpiece C. The upper needle position may be any position where the lower end 18 of the sewing needle 17 is above the needle plate 41, and the upper needle position may be a position where the lower end 18 of the sewing needle 17 is below or at the same height as the upper surface of the sewing workpiece C. The upper needle position may be the same position as the upper needle stop position in the upper-lower direction, may be above the upper needle stop position, or may be the top dead center. The normal position may be any position above the lowered position, and may be the same position regardless of the lowered position. The lower needle position and the upper needle stop position may be changed as appropriate. The processing of S8 may be performed based on a detection result of an encoder that detects a drive amount of the presser motor 35, or may be performed based on a detection result of a position sensor that detects a position of the presser bar 16 in the upper-lower direction.

In the second-stitch operation, based on the detection result of the movement detector 9 acquired before the presser bar 16 moves to the normal position, the controller 3 may move the needle bar 15 in the upper-lower direction at a particular speed or a speed corresponding to the movement amount of the sewing workpiece C in a state where the presser bar 16 is located at the normal position. In the second-stitch operation, based on the detection result of the movement detector 9 acquired before the needle bar 15 moves to the upper needle position, the controller 3 may move the needle bar 15 in the upper-lower direction at a particular speed in a state where the presser bar 16 is located at the normal position. The controller 3 may perform at least the second-stitch operation or the sewing control operation of the needle bar 15, based on the detection result of the movement detector 9 in a period in which the lower end 18 of the sewing needle 17 is above the needle plate 41. In a case where the movement detector 9 is configured to always output a positive value, the controller 3 may determine whether the movement amount is larger than a particular amount in S11 and S14.

After the second-stitch operation, the controller 3 may move the needle bar 15 in the upper-lower direction at a particular speed regardless of the movement amount of the sewing workpiece C, based on the detection result of the movement detector 9. In S11 and S14, the controller 3 may determine whether the absolute value of the movement amount is greater than or equal to a particular amount. During the sewing control operation, the controller 3 may omit the stop operation of stopping the needle bar 15 at the upper needle stop position in a case where the movement amount of the sewing workpiece C is smaller than or equal to a particular amount based on the detection result of the movement detector 9. In this case, the sewing machine 1 may stop the needle bar 15 when a stop instruction is detected, for example. In the stop operation, the controller 3 may stop the needle bar 15 at the lower needle position instead of the upper needle stop position. In this case, the stop operation performed by the controller 3 of the sewing machine 1 stops the needle bar 15 at the lower needle position, thereby contributing to making it easier to change (rotate) the orientation of the sewing workpiece C in a state where the sewing needle 17 is pierced to the sewing workpiece C while the sewing is interrupted. The controller 3 may stop the needle bar 15 at any position in the stop operation. The sewing machine 1 may automatically perform the first-stitch operation after a particular time has elapsed in a state where the needle bar 15 is located at the lower needle position, regardless of whether a sewing instruction is detected.

The above modifications may be combined as appropriate as long as no contradiction occurs. The applicant of the present application has an intention to acquire patent rights for aspects combined with each other within a range not departing from the scope of the present disclosure and not causing contradiction, in addition to the combinations exemplified in the claims.

What is claimed is:

1. A sewing machine comprising:

a needle bar extending in an upper-lower direction;

a needle plate formed with a needle hole;

a presser bar extending in the upper-lower direction;

a sewing machine motor configured to drive the needle bar to move in the upper-lower direction in a range including an upper needle position and a lower needle position, the upper needle position being a position where a lower end of a sewing needle attached to the needle bar is located above the needle plate, the lower needle position being a position where the lower end of the sewing needle attached to the needle bar is located below the needle plate;

a presser motor configured to drive the presser bar to move in the upper-lower direction in a range including a normal position and a lowered position, a lower end of the presser bar at the lowered position being located at a lower position than the lower end of the presser bar at the normal position; and a controller configured to perform:

a first-stitch operation of, at start or restart of sewing, driving the sewing machine motor to move the needle bar from the lower needle position to the upper needle position while positioning the presser bar at the lowered position, and then driving the presser motor to move the presser bar from the lowered position to the normal position after the needle bar reaches the upper needle position; and a second-stitch operation of, while positioning the presser bar at the normal position, driving the sewing machine motor to move the needle bar reciprocally in the upper-lower direction based on a detection result of movement of a sewing workpiece placed on the needle plate.

2. The sewing machine according to claim 1, wherein the upper needle position is a position where the lower end of the sewing needle is located above the needle plate and the lower end of the sewing needle is located above an upper surface of the sewing workpiece.

3. The sewing machine according to claim 1, wherein the controller is configured to perform:

acquiring a detection result of the movement of the sewing workpiece after the presser bar is moved to the normal position in the first-stitch operation; and in a case where the sewing workpiece has moved by a larger amount than a particular amount based on the detection result, in the second-stitch operation, driving the needle bar to move in the upper-lower direction at a particular speed in a state where the presser bar is located at the normal position.

4. The sewing machine according to claim 1, wherein the controller is configured to:

acquiring a detection result of the movement of the sewing workpiece after the needle bar is moved to the upper needle position in the first-stitch operation; and in a case where the sewing workpiece has moved by a larger amount than a particular amount based on the detection result, in the second-stitch operation, driving the needle bar to move in the upper-lower direction at a particular speed in a state where the presser bar is located at the normal position.

5. The sewing machine according to claim 1, wherein the controller is configured to perform:

a sewing control operation of, after the second-stitch operation, driving the sewing machine motor to move the needle bar in the upper-lower direction at a speed corresponding to a movement amount of the sewing workpiece based on a detection result of the movement of the sewing workpiece; and a stop operation of, during the sewing control operation, in a case where the movement amount of the sewing workpiece is smaller than or equal to a particular amount based on the detection result of the movement of the sewing workpiece, stopping driving the sewing machine motor at an upper needle stop position and stopping the needle bar, the upper needle stop position being a position where the lower end of the sewing needle is located above the needle plate.

6. The sewing machine according to claim 1, further comprising a movement detector configured to detect movement of the sewing workpiece placed on the needle plate, wherein the controller is configured to perform:

in the first-stitch operation, lowering the presser bar to the lowered position where the movement detector contacts the sewing workpiece;

moving the needle bar from the lower needle position to the upper needle position; and after moving the needle bar from the lower needle position to the upper needle position, moving the presser bar from the lowered position to the normal position, the normal position being a particular distance above the lowered position.

7. The sewing machine according to claim 1, further comprising an input interface, wherein the controller is configured to perform the first-stitch operation in response to detecting a sewing instruction via the input interface.

8. The sewing machine according to claim 1, further comprising a movement detector configured to detect movement of the sewing workpiece placed on the needle plate.

9. The sewing machine according to claim 8, wherein the movement detector is attached to the presser bar.

10. The sewing machine according to claim 1, further comprising:

a bed; and a movement detector configured to detect a movement amount of the sewing workpiece in a short direction of the bed and a movement amount of the sewing workpiece in a longitudinal direction of the bed.

11. A sewing machine comprising:

a needle bar extending in an upper-lower direction;

a needle plate formed with a needle hole;

a presser bar extending in the upper-lower direction;

a sewing machine motor;

a presser motor; and a controller configured to perform:

at start or restart of sewing, driving the sewing machine motor to move the needle bar from a lower needle position to an upper needle position while positioning the presser bar at a lowered position, and then driving the presser motor to move the presser bar from the lowered position to a normal position after the needle bar reaches the upper needle position, the upper needle position being a position where a lower end of a sewing needle attached to the needle bar is located above the needle plate, the lower needle position being a position where the lower end of the sewing needle attached to the needle bar is located below the needle plate, a lower end of the presser bar at the lowered position being located at a lower position than the lower end of the presser bar at the normal position; and while positioning the presser bar at the normal position, driving the sewing machine motor to move the needle bar reciprocally in the upper-lower direction based on a detection result of movement of a sewing workpiece placed on the needle plate.

* * * * *